United States Patent [19]

van den Berg et al.

[11] Patent Number: 4,754,635

[45] Date of Patent: Jul. 5, 1988

[54] DEVICE FOR DRAPE DRAWING A SHADOW MASK FOR A COLOR DISPLAY TUBE

[75] Inventors: Adrianus H. M. van den Berg; Kathryn C. Thompson-Russell, both of Eindhoven, Netherlands

[73] Assignee: U.S. Philips Corporation, New York, N.Y.

[21] Appl. No.: 53,928

[22] Filed: May 26, 1987

Related U.S. Application Data

[62] Division of Ser. No. 779,194, Sep. 23, 1985, Pat. No. 4,685,321.

[30] Foreign Application Priority Data

Sep. 28, 1984 [NL] Netherlands ..... 8402958

[51] Int. Cl.[4] ..... B21D 22/00

[52] U.S. Cl. ..... 72/350; 72/342; 72/347

[58] Field of Search ..... 72/342, 347, 350, 351, 72/364

[56] References Cited

U.S. PATENT DOCUMENTS

| | | | |
|---|---|---|---|
| 3,340,714 | 9/1967 | Pohl et al. | 72/342 |
| 3,528,276 | 9/1970 | Schmidt et al. | 72/342 |
| 3,584,487 | 6/1971 | Carlson | 72/342 |
| 3,703,093 | 11/1972 | Komatsu et al. | 72/342 |
| 4,090,389 | 5/1978 | van Denderen et al. | 72/350 |
| 4,145,903 | 3/1979 | Leach et al. | 72/342 |

*Primary Examiner*—W. Donald Bray
*Attorney, Agent, or Firm*—John C. Fox

[57] ABSTRACT

Device to drape draw a nickel-iron alloy, etched-aperture sheet, including means to heat the sheet at a temperature between 150° and 250° C. during drawing, whereby a 0.2% proof stress of the shadow mask material is reached below a tensile stress of $150^N/nm^2$. Accurate reproduction of shadow masks is thereby achieved with minimized detrition of the tooling.

3 Claims, 1 Drawing Sheet

DEVICE FOR DRAPE DRAWING A SHADOW MASK FOR A COLOR DISPLAY TUBE

This is a division of application Ser. No. 779,194, filed Sept. 23, 1985, U.S. Pat. No. 4,685,321.

BACKGROUND OF THE INVENTION

The invention relates to a method of drape drawing, by means of a drawing process, a shadow mask sheet for a color display tube consisting of a nickel-iron alloy.

A colour display tube usually comprises an envelope having a glass display window which has a display screen with phosphor regions luminescing in the colors red, green and blue. A shadow mask having a large number of apertures is mounted in the tube a short distance from the front of the display screen. During operation of the tube three electron beams are generated in the tube by an electron gun system, pass through the apertures in the shadow mask, and impinge onto the said phosphor regions. The mutual positions of the apertures and the phosphor regions are such that, upon writing the picture, each of the electron beams always impinges on phosphor regions of one color. However, a considerable proportion of the electrons impinge on the shadow mask, the kinetic energy of these electrons being converted into thermal energy so that the temperature of the shadow mask rises. The thermal expansion of the shadow mask associated with this rise in temperature may result in a local or complete bulge of the shadow mask as a result of which the mutual positions of the apertures in the shadow mask and the phosphor regions associated with these apertures are interfered with. This results in color defects in the displayed picture, which become more serious as the shadow mask is less convex. This flatter shape and resulting problem is found more and more in the present generation of color display tubes having flatter display windows.

It is known to mitigate such problems caused by thermal effects by manufacturing the shadow mask from a material having a low coefficient of thermal expansion. An example of such a material is an alloy of substantially iron and nickel in which the nickel content is approximately 36% by weight. The high tensile strength and hence difficult machinability of these alloys have hampered their use as shadow mask materials. A difficult machinability of the material generally leads to a rapid detrition of the drawing tools with which the shadow mask sheet is drape drawn. Moreover, the reproducibility of the drawing process decreases as a result of detrition of the drawing tools. A rapid detrition hence requires an intensive control and frequent maintenance of the drawing tool.

This detrition problem is the more prominent when, during the drawing process, a shadow mask sheet is clamped in a slipping manner over at least a part of its circumference. Since the shadow mask sheet is subjected to the drawing process after a pattern of apertures has already been provided therein, the tensile strength of the sheets will generally be different in mutually perpendicular directions. In order to prevent the shadow mask from being drawn to pieces during the drawing process in the direction of the smallest tensile strength, it is clamped in a slightly slipping manner in the direction of the smallest tensile strength. The frictional forces occurring during the resulting slipping movement should be reproducible in value so as to obtain a reproducible drawing process. As a result of detrition which is promoted by large frictional forces, the frictional forces no longer occur in a reproducible manner; and as a result the reproducibility of the drawing process also decreases.

SUMMARY OF THE INVENTION

It is an object of the invention to provide a method of drape drawing a shadow mask in which the detrition of the drawing tools is minimized and a good reproducibility of the drawing process is obtained. A further object of the invention is to provide a device for carrying out said method.

For that purpose, according to the invention, a method of drape drawing, by means of a drawing process, a shadow mask sheet consisting of a nickel-iron alloy for a color display tube is characterized in that prior to drawing the shadow mask, the sheet is annealed at a temperature between 700° and 820° C. for a period of time which is sufficient to produce a complete recrystallization without grain growth of any significance; and that during the drawing process the shadow mask sheet is maintained at a temperature between 150° and 250° so as to bring the 0.2% proof stress of the material of the shadow mask sheet below a tensile stress of 150 $N/mm^2$.

Prior to the actual drawing process the shadow mask sheet is subjected to an annealing treatment at a temperature between 700° C. and 820° C. for a period of time which is sufficient to produce complete recrystallization of the material of the shadow mask sheet. This annealing treatment serves a dual purpose: first, to produce a complete recrystallization of the material so that the drawing properties thereof are uniform throughout the shadow mask sheet without any essential grain growth occurring; and second, to reduce the tensile stress at the 0.2% proof stress of the material to approximately 300 $N/mm^2$ at ambient temperature.

It has been found that the annealing treatment must be carried out at temperatures higher than approximately 700° C. to achieve complete recrystallization. A considerable reduction of the tensile stress at the 0.2% proof stress is also obtained with respect to that of the cold-rolled material. When higher annealing temperatures with grain growth are used, the 0.2% proof stress decreases further, but for various reasons it has proved useful to impose an upper limit on the annealing temperature. According to the invention, this upper limit is approximately 820° C. In the temperature range from 700° C. to 820° C. the temperature dependence of the 0.2% proof stress with increasing temperature decreases sufficiently to be able to perform the method. Moreover, a temperature of 820° C. still permits the shadow masks to be annealed while stacked one on the other without being bonded together by thermomolecular welding processes.

Upon heating at a temperature between 150° and 250° C. the tensile stress can be reduced, the shadow mask material reaching the 0.2% proof stress. It has been established that the wear of the drawing tools and hence the reproducibility of the drawing process are at an acceptable level when this tensile stress does not exceed a value of approximately 150 $N/mm^2$. After cooling to ambient temperature the material substantially regains the original, comparatively high, 0.2% proof stress. This is another advantage of the invention. Shadow mask sheets manufactured according to the invention have a higher mechanical rigidity, in particular a greater resistance to indentation, than shadow mask sheets which have been subjected to an annealing treatment at a temperature at which an essential grain growth occurs.

The invention also relates to a device for drape drawing the shadow mask sheet. According to the invention, a device for drape drawing a shadow mask sheet for a color display tube, which device comprises a drawing die and furthermore a drawing ring and a pressure ring between which the shadow mask sheet can be clamped at its circumference, is characterized in that the drawing die, the pressure ring and the drawing ring comprise heating means. The heating means in the drawing tool bring and/or keep the shadow mask sheet at the desired temperature between 150° C. and 250° C. In a preferred embodiment the heating means are electrical heating means.

The invention will be described in greater detail with reference to the drawing.

DESCRIPTION OF THE PREFERRED EMBODIMENTS

Figure 1:
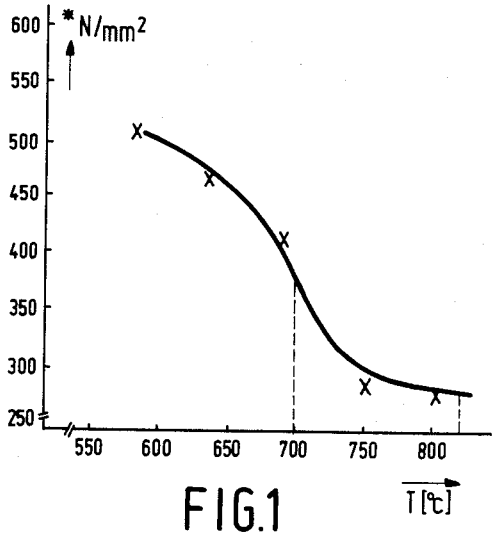
FIG. 1 is a graph of the tensile stress as a function of the annealing temperature of a nickel-iron alloy.

For a nickel-iron alloy consisting of 36% by weight of nickel, less than 0.04% by weight of carbon, less than 0.3% by weight of silicon, less than 0.5% by weight of manganese and the balance being iron, FIG. 1 shows the tensile stress reached as a function of the annealing temperature at which the material has its 0.2% proof stress. The starting material is a sheet obtained by cold-rolling and having a thickness of 100–150 micrometers (microns). Patterns of apertures are etched in the sheet by means of a photoetching method. These apertures may have any desired shape, for example, elongated slots or circular. After etching the apertures and tearing lines have also been etched, the sheet is severed into pieces each forming a shadow mask sheet and having a pattern of apertures. The material of the shadow mask sheet thus obtained has at room temperature a 0.2% proof stress which is reached at a tensile stress of approximately $600^N/mm^2$. This tensile stress is too high to draw the shadow mask sheet reproducibly to the desired shape.

In order to reduce the tensile stress, the shadow mask sheet is annealed for approximately 15 minutes at a temperature of approximately 750° C. in a hydrogen-containing gas atmosphere (6% $H_2$, remainder N2). A complete recrystallization of the material occurs. As is shown in FIG. 1, the 0.2% proof stress of the material thus annealed has dropped to approximately $300^N/mm^2$. Full recrystallization is necessary to ensure that this 0.2% proof stress is uniform throughout the shadow mask sheet.

It may also be derived from FIG. 1 that, in the temperature range from 700° C. to approximately 820° C., the temperature dependence of the 0.2% proof stress decreases considerably as the temperature increases. A further reduction of the 0.2% proof stress then requires comparatively much higher annealing temperatures. This is a disadvantage not only from energy considerations, but it also presents problems when the mask sheets are annealed in a stack. At such high temperatures above 820° C., the mask sheets may become bonded together as a result of thermomolecular welding action.

Figure 2:
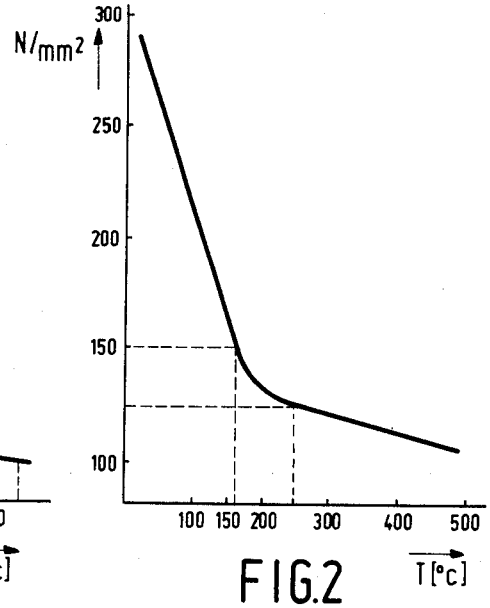
FIG. 2 is a graph of the tensile stress of the annealed nickel-iron alloy as a function of the temperature during the drawing process.

The 0.2% proof stress achieved at $300^N/mm^2$, however, is still too high to obtain a reproducible process for drape drawing the shadow mask sheet. For that purpose, a further reduction of the 0.2% proof stress has proved to be necessary. To realize this the shadow mask sheet is not drape drawn at room temperature but at a temperature between 150° C. and 250° C. FIG. 2 shows the variation of the tensile stress at the 0.2% proof stress as a function of the temperature. In the temperature range from 150° C. to 250° C. the temperature dependence of the 0.2% proof stress considerably decreases as the temperature increases. At temperatures above 250° C. a comparatively small reduction of the 0.2% proof stress is still obtained. At such high temperatures, however, practical problems with regard to the drawing tools start playing a role which outweighs the advantage of a lower 0.2% proof stress.

Figure 3:
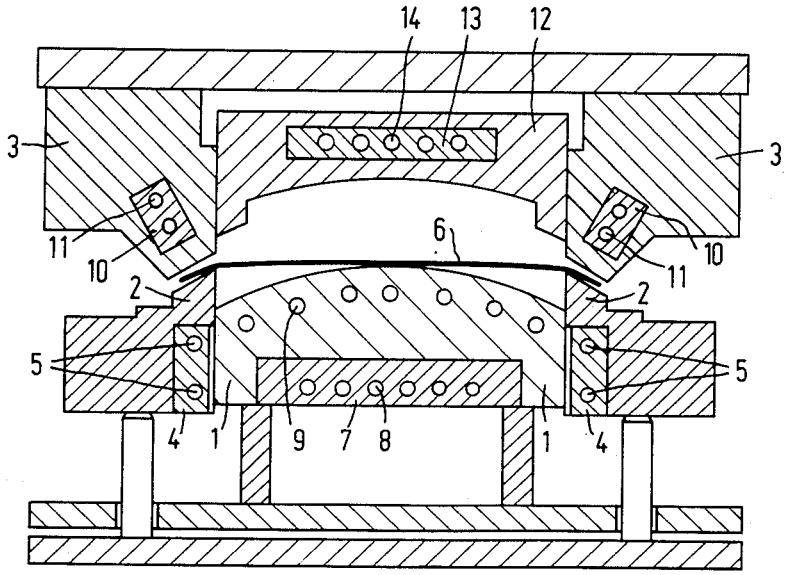
FIG. 3 is a diagrammatic sectional view of a device for drape drawing a shadow mask sheet.

FIG. 3 is a diagrammatic sectional view of a device for drape drawing a shadow mask sheet. The device comprises a draw die 1 (sometimes termed mandril), a pressure ring 2 (sometimes termed pleat holder) and a draw ring 3. A rectangular shadow mask sheet 6 is laid on the draw die 1. The draw ring 3 is moved towards the pressure ring 2 in the vertical direction as a result of which the sheet 6 is clamped on two opposite sides of a rectangle between the draw ring 3 and the pressure ring 2. On the two other opposite sides of the rectangle, a gap larger than the thickness of the shadow mask sheet 6 is maintained between the draw ring 3 and the pressure ring 2. This gap enables the shadow mask sheet to slip during the drawing process and the size of the gap determines the frictional resistance occurring. In the present case the shadow mask sheet in the direction perpendicular to the non rigidly clamped sides of the rectangle has a smaller tensile strength than in the direction at right angles to the firmly clamped sides. Such a gap can simply be obtained by a suitable shape of the draw ring and/or the pressure ring. It is also possible to compose the draw ring and/or the pressure ring of four ring portions. Each ring portion then is associated with one side of the shadow mask sheet.

Drawing the shadow mask sheet to the desired frusto-spherical shape now takes place by simultaneously lowering the draw ring 3 and the pressure ring 2. The shadow mask sheet is then drawn over the draw die 1. During this drawing process the temperature of the shadow mask sheet is kept at approximately 200° C. In order to realize this the draw die 1 comprises a copper block 7 in which electric heating elements 8 are present. Similarly, the pressure ring 2 is provided with copper blocks 4 having heating elements 5 and the draw ring 3 is provided with copper blocks 10 having heating elements 11. The shadow mask sheet 10 can be heated by the drawing tools heated at 200° C. However, it may also be heated previously in a furnace at a temperature of approximately 200° C. In order to keep the temperature uniform across the shadow mask sheet during the drawing process, the draw die 1 comprises a number of heat pipes 9 which ensure a temperature equalization at the surface of the draw die.

After drawing the shadow mask sheet to the desired frusto-spherical shape, it is provided at its circumference with a skirt by bending over the four rectangular sides. This is done by further lowering the draw ring 3 in which, of course, the shadow mask sheet at its circumference is no longer clamped between the pressure ring and the draw ring. During forming the skirt at the periphery of the shadow mask the shadow mask sheet is urged against the draw die 1 by an ejector 12. The ejector 12 also comprises a copper block 13 having heating elements 14 so that the shadow mask contacts an ejector which is also heated at 200° C. After the skirt of the shadow mask has been formed, the ejector 12 is moved away from the shadow mask. The draw ring 3 is then moved upwards and takes along the shadow mask. The shadow mask is finally ejected from the draw ring 3 by the ejector 12 and is then removed.

It is to be noted that the operating members for the draw ring 3, the pressure ring 2 and the ejector 12 are not shown in FIG. 3 since they do not directly form part of the present invention.

In practice it is also possible to clamp the mask all-sided.

What is claimed is:

1. A device for drape drawing a rectangular shadow mask sheet for a color display tube, the device comprising a draw die and furthermore a draw ring and a pressure ring between which the shadow mask sheet can be clamped at its periphery during drawing on the draw die, the draw ring and pressure ring configured to clamp the sheet on two opposite sides and to allow the sheet to slip on the remaining two sides, the device furthermore comprising an ejector for urging the sheet against the draw die during drawing, and for ejecting the mask from the draw ring after forming, the draw die, draw ring, pressure ring and ejector each comprising a block containing heating means, and the draw die additionally comprising a plurality of heat pipes for insuring temperature equalization at the surface of the draw die.

2. A device as claimed in claim 1 wherein the heating means consists of electric heating elements.

3. A device as claimed in claim 1 wherein the blocks are copper.

* * * * *